United States Patent [19]

Kwon et al.

[11] Patent Number: 4,713,290

[45] Date of Patent: Dec. 15, 1987

[54] HIGH STRENGTH AND MODULUS POLYVINYL ALCOHOL FIBERS AND METHOD OF THEIR PREPARATION

[75] Inventors: Young D. Kwon, Morristown; Sheldon Kavesh, Whippany; Dusan C. Prevorsek, Morristown, all of N.J.

[73] Assignee: Allied Corporation, Morris Township, Morris County, N.J.

[21] Appl. No.: 821,374

[22] Filed: Jan. 22, 1986

Related U.S. Application Data

[62] Division of Ser. No. 569,818, Jan. 11, 1984, Pat. No. 4,599,267, which is a division of Ser. No. 432,044, Sep. 30, 1982, Pat. No. 4,440,711.

[51] Int. Cl.[4] ..... D02G 3/00

[52] U.S. Cl. ..... 428/364; 264/210.8; 264/285; 525/56; 525/319

[58] Field of Search ..... 428/364; 264/210.8, 264/285; 525/56, 319

[56] References Cited

U.S. PATENT DOCUMENTS

| | | | |
|---|---|---|---|
| 4,440,711 | 4/1984 | Kwon et al. | 264/185 |
| 4,599,267 | 7/1986 | Kwon et al. | 428/364 |
| 4,603,083 | 7/1986 | Tanaka et al. | 428/364 |

FOREIGN PATENT DOCUMENTS

| | | |
|---|---|---|
| 3004699 | 8/1980 | Fed. Rep. of Germany . |
| 1100497 | 1/1968 | United Kingdom . |
| 2051667 | 1/1981 | United Kingdom . |

*Primary Examiner*—George F. Lesmes
*Assistant Examiner*—S. A. Gibson
*Attorney, Agent, or Firm*—Richard A. Negin; Richard C. Stewart; Gerhard H. Fuchs

[57] ABSTRACT

Polyvinyl alcohol of molecular weight over 500,000 (i.e. 1,500,000 to 2,500,000) is spun as a dilute solution (2–15%) in a relatively non-volatile solvent such as glycerin. The resultant gel fiber is extracted with a volatile solvent such as methanol and dried. Upon stretching at one or more stages during the process, fibers of tenacity above 10 g/denier and modulus above 200 g/denier (e.g. 18 and 450, respectively) are produced.

29 Claims, 3 Drawing Figures

HIGH STRENGTH AND MODULUS POLYVINYL ALCOHOL FIBERS AND METHOD OF THEIR PREPARATION

RELATED U.S. APPLICATION DATA

This application is a division of application Ser. No. 569,818 filed Jan. 11, 1984 U.S. Pat. No. 4,599,267 which in turn is a division of application Ser. No. 432,044 filed Sept. 30, 1982 U.S. Pat. No. 4,440,711.

DESCRIPTION

The present invention relates to polyvinyl alcohol fibers of high molecular weight, strength (tenacity) and tensile modulus, and methods of preparing same via the extrusion of dilute solutions to prepare gel fibers which are subsequently stretched.

Zwick et al. in Soc Chem Ind. London, Monograph No. 30, pp. 188–207 (1968) describe the spinning of polyvinyl alcohol by a Phase Separation technique said to differ from earlier Wet Spinning, Dry Spinning and Gel Spinning techniques. The reference indicates that the earlier systems employ 10–20%, 25–40% and 45–55% polymer concentrations, respectively, and that they differ in the manner in which low molecular weight materials (solvents such as water) are removed. The reference also indicates some earlier systems to be restricted in spinneret hole size, attenuation permitted or required, maximum production speed and attainable fiber properties.

The Phase Separation process described in Zwick et al. (see also UK Pat. No. 1,100,497) employs a polymer content of 10–25% (broadly 5–25% in the Patent which covers other polymers as well) dissolved at high temperatures in a one or two-component solvent (low molecular weight component) system that phase separates on cooling. This phase separation took the form of polymer gellation and solidification of the solvent (or one of its components), although the latter is indicated in the Patent to be optional. The solution was extruded through apertures at the high temperature through unheated air and wound up at high speeds hundreds or thousands of times greater than the linear velocity of the polymer solution through the aperture. Thereafter the fibers were extracted to remove the occluded or exterior solvent phase, dried and stretched. An earlier, more general description of Phase Separation Spinning is contained in Zwick *Applied Polymer Symposia*, no. 6, pp. 109–49 (1967).

Modifications in the spinning of hot solutions of ultrahigh molecular weight polyethylene (see Examples 21–23 of UK Pat. No. 1,100,497) have been reported by Smith and Lemstra and by Pennings and coworkers in varius articles and patents including German Offen No. 3004699 (Aug. 21, 1980); UK Application No. 2,051,667 (Jan. 21, 1981); Polymer Bulletin, vol. 1, pp. 879–880 (1979) and vol. 2, pp. 775–83 (1980); and Polymer 2584–90 91980). Copending commonly assigned applications of Kavesh et al., U.S. Pat. No. 4,413,110 and abandoned application Ser. No. 359,020 describe processes including the extrusion of dilute, hot solutions of ultrahigh molecular weight polyethylene or polypropylene in a nonvolatile solvent followed by cooling, extraction, drying and stretching. While certain other polymers are indicated in U.S. Pat. No. 4,413,110 as being useful in addition to polyethylene or polypropylene, such polymers do not include polyvinyl alcohol or similar materials.

While U.K. Pat. No. 1,100,497 indicates molecular weight to be a factor in selecting best polymer concentration (page 3, lines 16–26), no indication is given that higher molecular weights give improved fibers for polyvinyl alcohol. The Zwick article in *Applied Polymer Symposia* suggests 20–25% polymer concentration as optimum for fiber-grade polyvinyl alcohol, but 3% polymer concentration to be optional for polyethylene. The Zwick et al article states the polyvinyl alcohol content of 10–25% in the polymer solution to be optimal, at least in the system explored in most detail where the solvent or a component of the solvent solidified on cooling to concentrate the polyvinyl alcohol in the liquid phase on cooling before the polyvinyl alcohol gels.

Unlike the systems used in the Kavesh et al. applications and Smith and Lemstra patents, all three versions of Zwick's Phase Separation process take up the fiber directly from the air gap, without a quench bath, such that the draw-down ocurred over a relatively large length of cooling fiber.

BRIEF DESCRIPTION OF THE INVENTION

The present invention includes a process comprising the steps:

(a) forming a solution of a linear polyvinyl alcohol having a weight average molecular weight at least 500,000 in a first solvent at a first concentration between about 2 and about 15 weight percent polyvinyl alcohol, (b) extruding said solution through an aperture, said solution being at a temperature no less than a first temperature upstream of the aperture and being substantially at the first concentration both upstream and downstream of said aperture, (c) cooling the solution adjacent to and downstream of the aperture to a second temperature below the temperature at which a rubbery gel is formed, forming a gel containing first solvent of substantially indefinite length, (d) extracting the gel containing first solvent with a second, volatile solvent for a sufficient contact time to form a fibrous structure containing second solvent, which structure is substantially free of first solvent and is of substantially indefinite length;

(e) drying the fibrous structure containing second solvent to form a xerogel of substantially indefinite length free of first and second solvent; and (f) stretching at least one of:

(i) the gel containing the first solvent, (ii) the fibrous structure containing the second solvent and, (iii) the xerogel, at a total stretch ratio sufficient to achieve a tenacity of at least about 10 g/denier and a modulus of at least 200 g/denier.

The present invention also includes novel stretched polyvinyl alcohol fibers of weight average molecular weight at least about 500,000, tenacity at least about 10 g/denier, tensile modulus at least about 200 g/denier and melting point at least about 238° C.

The present invention also includes novel stretched polyvinyl alcohol fibers of weight average molecular weight at least about 750,000, tenacity at least about 14 g/denier and tensile modulus at least about 300 g/denier.

DETAILED DESCRIPTION OF THE INVENTION

Figure 1:
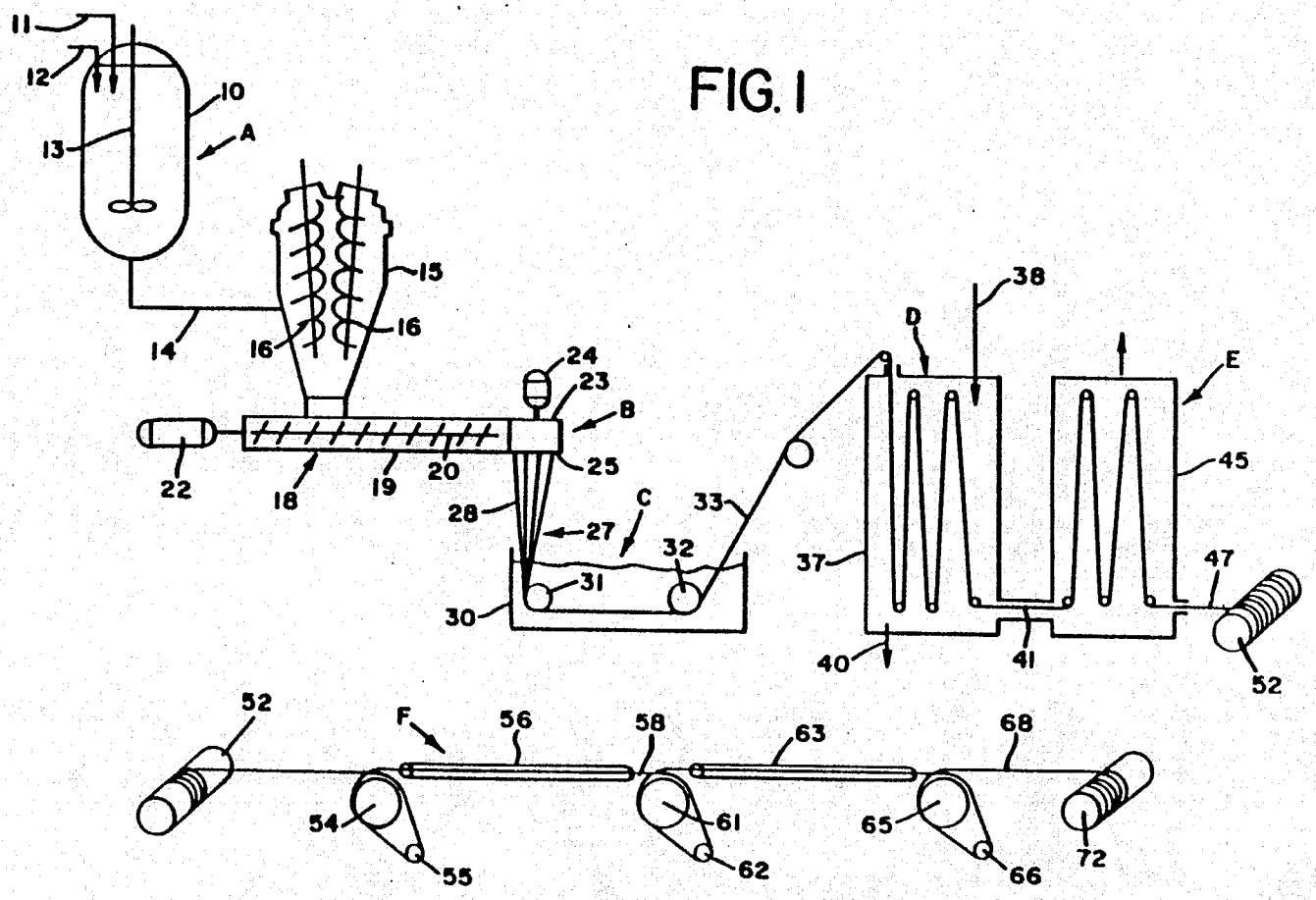

The process and fibers of the present invention employ a linear ultrahigh molecular weight polyvinyl alcohol (PV-OH) described more fully below that enables the preparation of PV-OH fibers (and films) of heretofore unobtained properties by extrusion of dilute solutions of concentration lower than used in Wet Spinning, Dry Spinning, Gel Spinning or Phase Separation Spinning, all as described by Zwick, Zwick et al. and UK Pat. No. 1,100,497. Furthermore, the preferred solvents of the present invention do not phase-separate from PV-OH on cooling to form a non-PV-OH coating or occluded phase, but rather form a dispersed fairly homogeneous gel unlike that achieved in Phase Separation Processes. The ability to process such gels formed by extruding and cooling dilute solutions is different from conventional gel spinning of PV-OH, which, according to Zwick et al, requires an even higher solid content of the spinning dope (45–55%) to allow the polymer to be extruded and fibers to be collected in the form of a concentrated, tough gel without prior removal of solvent.

The PV-OH polymer used is linear and of weight average molecular weight at least about 500,000, preferably at least about 750,000, more preferably between about 1,000,000 and about 4,000,000 and most preferably between about 1,500,000 and about 2,500,000. The term linear is intended to mean no more than minimal branches of either the alpha or beta type. Since the most common branching in polyvinyl acetate (PV-Ac) manufacture is on the acetate side-groups, such branching will result in side-groups being split off during hydrolysis or methanolysis to PV-OH and will result in the PV-OH size being lowered rather than its branching increased. The amount of total branching can be determined most rigorously by nuclear magnetic resonance. While totally hydrolyzed material (pure PV-OH) is preferred, copolymers with some vinyl acetate remaining may be used.

Such linear ultrahigh molecular weight PV-OH can be prepared by low temperature photoinitiated vinyl acetate polymerization, followed by methanolysis, using process details described in U.S. Pat. No. 4,463,138 as exemplified in the description preceding Table I, below.

The first solvent should be non-volatile under the processing conditions. This is necessary in order to maintain essentially constant the concentration of solvent upstream and through the aperture (die) and to prevent non-uniformity in liquid content of the gel fiber or film containing first solvent. Preferably, the vapor pressure of the first solvent should be no more than 80 kPa (four-fifths of an atmosphere) at 180° C., or at the first temperature. Suitable first solvents for PV-OH include aliphatic and aromatic alcohols of the desired non-volatility and solubility for the polymer. Preferred are the hydrocarbon polyols and alkylene ether polyols having a boiling point (at 101 kpa) between about 150° C. and abot 300° C., such as ethylene glycol, propylene glycol, glycerol, diethylene glycol and triethylene glycol. Also suitable are water and solutions in water or in alcohols of various salt such as lithium chloride, calcium chloride or other materials capable of disrupting hydrogen bonds and thus increasing the solubility of the PV-OH. The polymer may be present in the first solvent at a first concentration which is selected from a relatively narrow range, e.g. 2 to 15 weight percent, preferably 4 to 10 weight percent; however, once chosen, the concentration should not vary adjacent the die or otherwise prior to cooling to the second temperature. The concentration should also remain reasonably constant over time (i.e. length of the fiber or film).

The first temperature is chosen to achieve complete dissolution of the polymer in the first solvent. The first temperature is the minimum temperature at any point between where the solution is formed and the die face, and must be greater than the gelation temperature for the polymer in the solvent at the first concentration. For PV-OH in glycerine at 5–15% concentration, the gelation temperature is approximately 25°–100° C.; therefore, a preferred first temperature can be between 130° C. and 250° C., more preferably 170°–230° C. While temperatures may vary above the first temperature at various points upstream of the die face, excessive temperatures causitive of polymer degradation should be avoided. To assure complete solubility, a first temperature is chosen whereat the solubility of the polymer exceeds the first concentration and is typically at least 20% greater. The second temperature is chosen whereat the first solvent-polymer system behaves as a gel, i.e., has a yield point and reasonable dimensional stability for subsequent handling. Cooling of the extruded polymer solution from the first temperature to the second temperature should be accomplished at a rate sufficiently rapid to form a gel fiber which is of substantially the same polymer concentration as existed in the polymer solution. Preferably the rate at which the extruded polymer solution is cooled from the first temperature to the second temperaure should be at least 50° C. per minute.

A preferred means of rapid cooling to the second temperature involves the use of a quench bath containing a liquid such as a hydrocarbon (e.g., paraffin oil) into which the extruded polymer solution falls after passage through an air gap (which may be an inert gas). It is contemplated to combine the quench step with the subsequent extraction by having a second solvent (e.g., methanol) as the quench liquid. Normally, however, the quench liquid (e.g., parrafin oil) and the first solvent (e.g., glycerol) have only limited miscibility.

Some stretching during cooling to the second temperature is not excluded from the present invention, but the total stretching during this stage should not normally exceed 10:1. As a result of those factors the gel fiber formed upon cooling to the second temperature consists of a continuous polymeric network highly swollen with solvent.

If an aperture of circular cross section (or other cross section without a major axis in the plane perpendicular to the flow direction more than 8 times the smallest axis in the same plane, such as oval, Y- or X-shaped aperture) is used, then both gels will be gel fibers, the xerogel will be an xerogel fiber and the thermoplastic article will be a fiber. The diameter of the aperture is not critical, with representative apertures being between 0.25 mm and 5 mm in diameter (or other major axis). The length of the aperture in the flow direction should normally be at least 10 times the diameter of the aperture (or other similar major axis), perferably at least 15 times and more preferably at least 20 times the diameter (or other similar major axis).

If an aperture of rectangular cross section is used, then both gels will be gel films, the xerogel will be a xerogel film and the thermoplastic article will be a film.

The width and height of the aperture are not critical, with representative apertures being between 2.5 mm and 2 m in width (corresponding to film width), between 0.25 mm and 5 mm in height (corresponding to film thickness). The depth of the aperture (in the flow direction) should normally be at least 10 times the height of the aperture, preferably at least 15 times the height and more preferably at least 20 times the height.

The extraction with second solvent is conducted in a manner that replaces the first solvent in the gel with second more volatile solvent. When the first solvent is glycerine or ethylene glycol, suitable second solvents include methanol, ethanol, ethers, acetone, ketones and dioxane. Water is also a suitable second solvent, either for extraction of glycerol (and similar polyol first solvents) or for leaching of aqueous salt solutions as first solvent. The most preferred second solvent is methanol (B.P. 64.7° C.). Preferred second solvents are the volatile solvents having an atmospheric boiling point below 80° C., more preferably below 70° C. Conditions of extraction should remove the first solvent to less than 1% of the total solvent in the gel.

With some first solvents such as water or ethylene glycol, it is contemplated to evaporate the solvent from the gel fiber near the boiling point of the first solvent instead of or prior to extraction.

A preferred combination of conditions is a first temperature between 130° C. and 250° C., a second temperature between 0° C. and 50° C. and a cooling rate between the first temperature and the second temperature of at least 50° C./minute. It is preferred that the first solvent be an alcohol. The first solvent should be substantially non-volatile, one measure of which is that its vapor pressure at the first temperature should be less than four-fifths atmosphere (80 kPa), and more preferably less than 10 kPa. In choosing the first and second solvents, the primary desired difference relates to volatility as discussed above.

Once the fibrous structure containing second solvent is formed, it is then dried under conditions where the second solvent is removed leaving the solid network of polymer substantially intact. By analogy to silica gels, the resultant material is called herein a "xerogel" meaning a solid matrix corresponding to the solid matrix of a wet gel, with the liquid replaced by gas (e.g. by an inert gas such as nitrogen or by air). The term "xerogel" is not intended to delineate any particular type of surface area, porosity or pore size.

A comparison of the xerogels of the present invention with corresponding dried gel fibers prepared according to Phase Separation Spinning is expected to yield some morphological differences.

Stretching may be performed upon the gel fiber after cooling to the second temperature or during or after extraction. Alternatively, stretching of the xerogel fiber may be conducted, or a combination of gel stretch and xerogel stretch may be performed. The stretching may be conducted in a single stage or it may be conducted in two or more stages. The first stage stretching may be conducted at room temperatures or at an elevated temperature. Preferably the stretching is conducted in two or more stages with the last of the stages performed at a temperature between 120° C. and 250° C. Most preferably the stretching is conducted in at least two stages with the last of the stages performed at a temperature between 150° C. and 250° C.

Such temperatures may be achieved with heated tubes as in the Figures, or with other heating means such as heating blocks or steam jets.

The product PV-OH fibers produced by the present process represent novel articles in that they include fibers with a unique combination of properties: a molecular weight of at least about 500,000, a modulus at least about 200 g/denier, a tenacity at least about 10 g/denier, melting temperature of at least about 238° C. For this fiber, the molecular weight is preferably at least about 750,000, more preferably between about 1,000,000 and about 4,000,000 and most preferably between about 1,500,000 and about 2,500,000. The tenacity is preferably at least about 14 g/denier and more preferably at least about 17 g/denier. The tensile modulus is preferably at least about 300 g/denier, more preferably 400 g/denier and most preferably at least about 550 g/denier. The melting point is preferably at least about 245° C.

It is also contemplated that the preferred other physical properties can be achieved without the 238° C. melting point, especially if the PV-OH contains comonomers such as unhydrolyzed vinyl acetate. Therefore, the invention includes PV-OH fibers with molecular weight at least about 750,000, tenacity of at least about 14 g/denier and tensile modulus at least about 300 g/denier, regardless of melting point. Again, the more preferred values are molecular weight between about 1,000,000 and about 4,000,000 (especially about 1,500,000–2,500,000), tenacity at least about 17 g/denier and modulus at least about 400 g/denier (especially at least about 550 g/denier). The product PV-OH fibers also exhibit shrinkage at 160° C. less than 2% in most cases. Preferably the fiber has an elongation to break at most 7%.

DESCRIPTION OF THE PREFERRED EMBODIMENTS

FIG. 1, illustrates in schematic form a first embodiment of the present invention, wherein the stretching step F is conducted in two stages on the xerogel fiber subsequent to drying step E. In FIG. 5, a first mixing vessel 10 is shown, which is fed with an ultra high molecular weight polymer 11 such as PV-OH of weight average molecular weight at least 500,000 and frequently at least 750,000, and to which is also fed a first, relatively non-volatile solvent 12 such as glycerine. First mixing vessel 10 is equipped with an agitator 13. The residence time of polymer and first solvent in first mixing vessel 10 is sufficient to form a slurry containing some dissolved polymer and some relatively finely divided polymer particles, which slurry is removed in line 14 to an intensive mixing vessel 15. Intensive mixing vessel 15 is equipped with helical agitator blades 16. The residence time and agitator speed in intensive mixing vessel 15 is sufficient to convert the slurry into a solution. It will be appreciated that the temperature in intensive mixing vessel 15, either because of external heating, heating of the slurry 14, heat generated by the intensive mixing, or a combination of the above is sufficiently high (e.g. 200° C.) to permit the polymer to be completely dissolved in the solvent at the desired concentration (generally between 5 and 10 percent polymer, by weight of solution). From the intensive mixing vessel 15, the solution is fed to an extrusion device 18, containing a barrel 19 within which is a screw 20 operated by motor 22 to deliver polymer solution at reasonably high pressure to a gear pump and housing 23 at a controlled flow rate. A motor 24 is provided to drive gear pump 23 and extrude the polymer solution, still hot, through a spinnerette 25 comprising a plurality of aperatures, which may be circular, X-shaped, or, oval-shaped, or in any of a variety of shapes having a relatively small major axis in the plane of the spinnerette when it is desired to form fibers, and having a rectangular or other shape with an extended major axis in the plane of the spinnerette when it is desired to form films. The temperature of the solution in the mixing vessel 15, in the extrusion device 18 and at the spinnerette 25 should all equal or exceed a first temperature (e.g. 190° C.) chosen to exceed the gellation temperature (approximately 25°-100° C. for PV-OH in glycerine). The temperature may vary (e.g. 190° C., 180° C.) or may be constant (e.g. 190° C.) from the mixing vessel 15 to extrusion device 18 to the spinnerette 25. At all points, however, the concentration of polymer in the solution should be substantially the same. The number of aperatures, and thus the number of fibers formed, is not critical, with convenient numbers of apperatures being 16, 120, or 240.

From the spinnerette 25, the polymer solution passes through an air gap 27, optionally enclosed and filled with an inert gas such as nitrogen, and optionally provided with a flow of gas to facilitate cooling. A plurality of gel fibers 28 containing first solvent pass through the air gap 27 and into a quench bath 30 containing any of a variety of liquids, so as to cool the fibers, both in the air gap 27 and in the quench bath 30, to a second temperature at which the solubility of the polymer in the first solvent is relatively low, such that the polymer-solvent system solidifies to form a gel. It is preferred that the quench liquid in quench batch 30 be a hydrocarbon such as paraffin oil. While some stretching in the air gap 27 is permissible, it is preferably less than about 10:1.

Rollers 31 and 32 in the quench bath 30 operate to feed the fiber through the quench bath, and preferably operate with little or no stretch. In the event that some stretching does occur across rollers 31 and 32, some first solvent exudes out of the fibers and can be collected as a top layer in quench bath 30.

From the quench bath 30, the cool first gel fibers 33 pass to a solvent extraction device 37 where a second solvent, being of relatively low boiling such as methanol, is fed in through line 38. The solvent outflow in line 40 contains second solvent and essentially all of the first solvent brought in with the cool gel fibers 33, either dissolved or dispersed in the second solvent. Thus the fibrous structure 41 conducted out of the solvent extraction device 37 contains substantially only second solvent, and relatively little first solvent. The fibrous structure 41 may have shrunken somewhat compared to the first gel fibers 33.

In a drying device 45, the second solvent is evaporated from the fibrous structure 41, forming essentially unstretched xerogel fibers 47 which are taken up on spool 52.

From spool 52, or from a plurality of such spools if it is desired to operate the stretching line at a slower feed rate than the take up of spool 52 permits, the fibers are fed over driven feed roll 54 and idler roll 55 into a first heated tube 56, which may be rectangular, cylindrical or other convenient shape. Sufficient heat is applied to the tube 56 to cause the fiber temperature to be between 150°-250° C. The fibers are stretched at a relatively high draw ratio (e.g. 5:1) so as to form partially stretched fibers 58 taken up by driven roll 61 and idler roll 62. From rolls 61 and 62, the fibers are taken through a second heated tube 63, heated so as to be at somewhat higher temperature, e.g. 170°-250° C. and are then taken up by driven take-up roll 65 and idler roll 66, operating at a speed suficient to impart a stretch ratio in heated tube 63 as desired, e.g. 1.8:1. The twice stretched fibers 68 produced in this first embodiment are taken up on take-up spool 72.

With reference to the six process steps of the present invention, it can be seen that the solution forming step A is conducted in mixers 13 and 15. The extruding step B is conducted with device 18 and 23, and especially through spinnerette 25. The cooling step C is conducted in airgap 27 and quench bath 30. Extraction step D is conducted in solvent extraction device 37. The drying step E is conducted in drying device 45. The stretching step F is conducted in elements 52-72, and especially in heated tubes 56 and 63. It will be appreciated, however, that various other parts of the system may also perform some stretching, even at temperatures substantially below those of heated tubes 56 and 63. Thus, for example, some stretching (e.g. 2:1) may occur within quench bath 30, within solvent extraction device 37, within drying device 45 or between solvent extraction device 37 and drying device 45.

Figure 2:
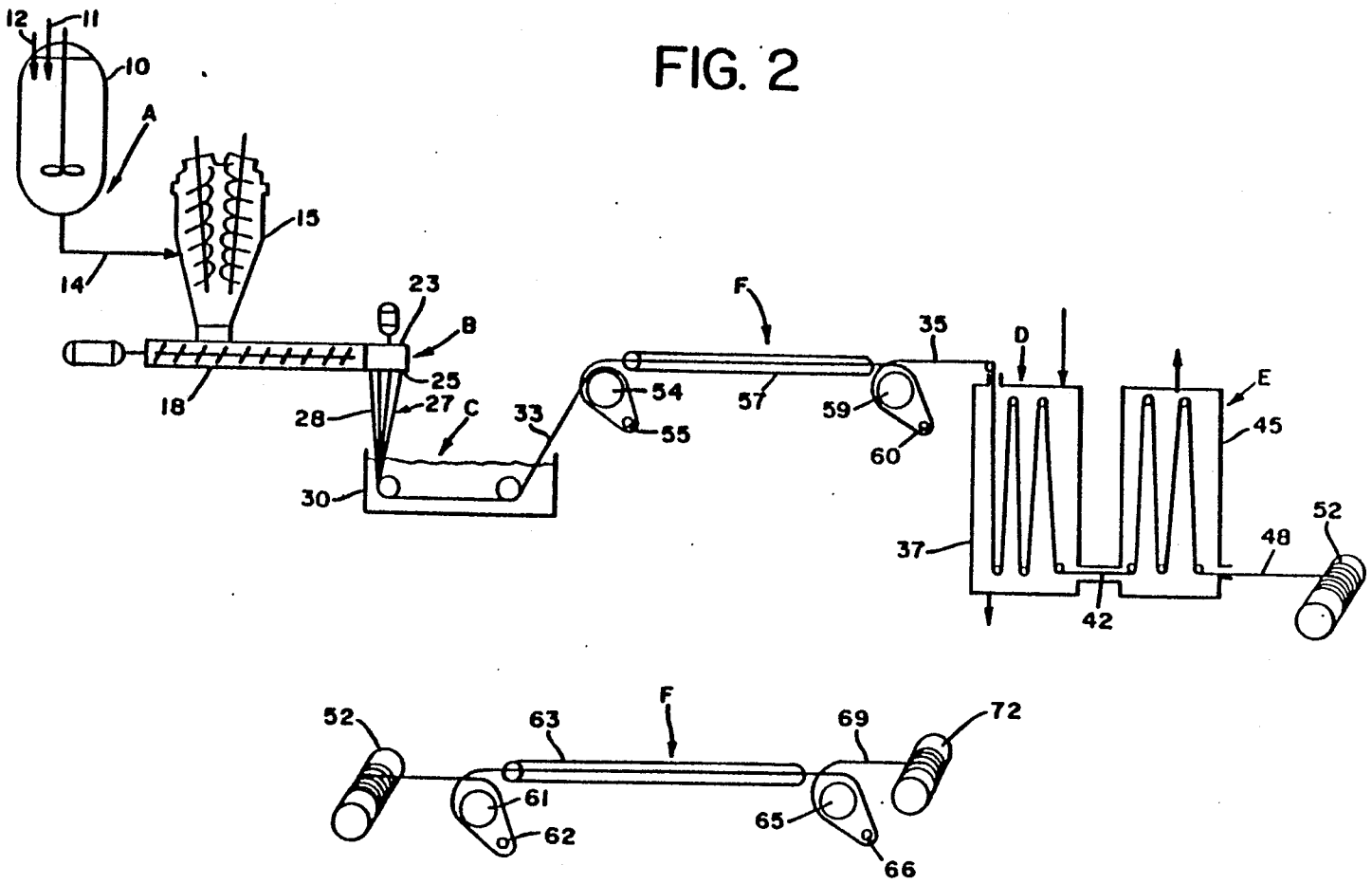

A second embodiment of the present invention is illustrated in schematic form by FIG. 2. The solution forming and extruding steps A and B of the second embodiment are substantially the same as those in the first embodiment illustrated in FIG. 1. Thus, polymer and first solvent are mixed in first mixing vessel 10 and conducted as a slurry in line 14 to intensive mixing device 15 operative to form a hot solution of polymer in first solvent. Extrusion device 18 impells the solution under pressure through the gear pump and housing 23 and then through a plurality of apperatures in spinnerette 27. The hot first gel fibers 28 pass through air gap 27 and quench bath 30 so as to form cool first gel fibers 33.

The cool first gel fibers 33 are conducted over driven roll 54 and idler roll 55 through a heated tube 57 which, in general, is longer than the first heated tube 56 illustrated in FIG. 5. The fibers 33 are drawn through heated tube 57 by driven take-up roll 59 and idler roll 60, so as to cause a relatively high stretch ratio (e.g. 10:1). The once-stretched first gel fibers 35 are conducted into extraction device 37.

In the extraction device 37, the first solvent is extracted out of the gel fibers by second solvent and the fibrous structures 42 containing second solvent are conducted to a drying device 45. There the second solvent is evaporated from the fibrous structures; and xerogel fibers 48, being once-stretched, are taken up on spool 52.

Fibers on spool 52 are then taken up by driven feed roll 61 and idler 62 and passed through a heated tube 63, operating at the relatively high temperature of between 170° and 270° C. The fibers are taken up by driven take up roll 65 and idler roll 66 operating at a speed sufficient to impart a stretch in heated tube 63 as desired, e.g. 1.8:1. The twice-stretched fibers 69 produced in the second embodiment are then taken up on spool 72.

It will be appreciated that, by comparing the embodiment of FIG. 2 with the embodiment of FIG. 1, the stretching step F has been divided into two parts, with the first part conducted in heated tube 57 performed on the first gel fibers 33 prior to extraction (D) and drying (E), and the second part conducted in heated tube 63, being conducted on xerogel fibers 48 subsequent to drying (E).

Figure 3:
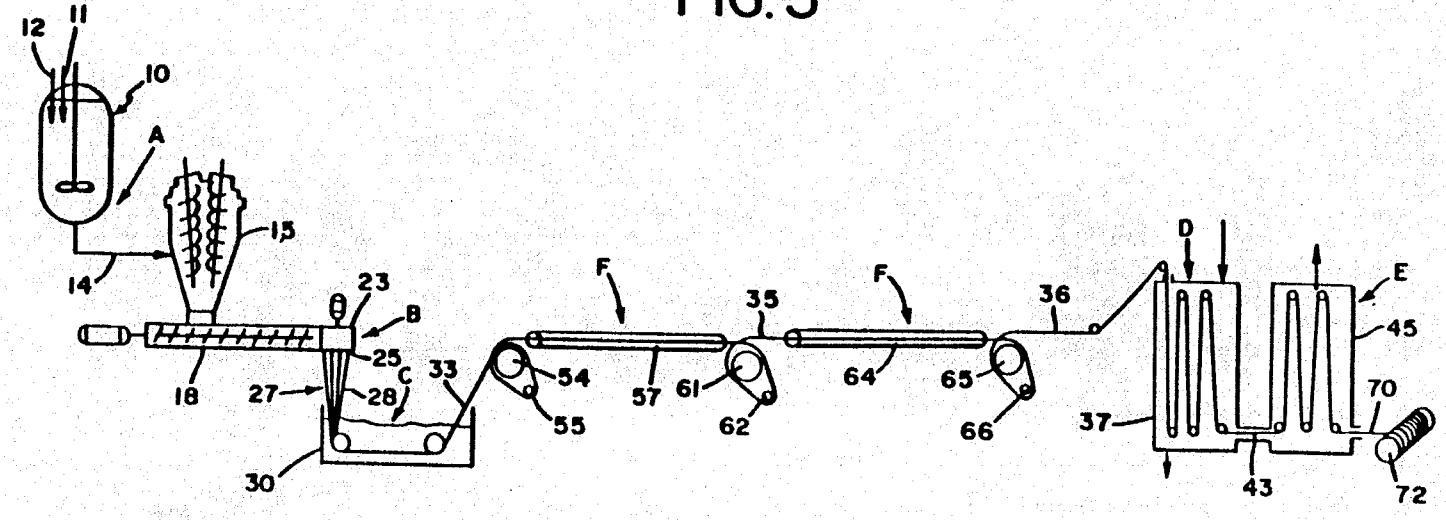

The third embodiment of the present invention is illustrated in FIG. 3, with the solution forming step A, extrusion step B, and cooling step C being substantially identical to the first embodiment of FIG. 1 and the second embodiment of FIG. 2. Thus, polymer and first solvent are mixed in first mixing vessel 10 and conducted as a slurry in line 14 to intensive mixing device 15 operative to form a hot solution of polymer in first solvent. Extrusion device 18 impells the solution under pressure through the gear pump and housing 23 and then through a plurality of apertures in spinnerette 27. The hot first gel fibers 28 pass through air gap 27 and quench bath 30 so as to form cool first gel fibers 33.

The cool first gel fibers 33 are conducted over driven roll 54 and idler roll 55 through a heated tube 57 which, in general, is longer than the first heated tube 56 illustrated in FIG. 5. The length of heated tube 57 compensates, in general, for the higher velocity of fibers 33 in the third embodiment of FIG. 7 compared to the velocity of xerogel fibers (47) between takeup spool 52 and heated tube 56 in the first embodiment of FIG. 1. The first gel fibers 33 are now taken up by driven roll 61 and idler roll 62, operative to cause the stretch ratio in heated tube 57 to be as desired, e.g. 5:1.

From rolls 61 and 62, the once-drawn first gel fibers 35 are conducted into modified heated tube 64 and drawn by driven take up roll 65 and idler roll 66. Driven roll 65 is operated sufficiently fast to draw the fibers in heated tube 64 at the desired stretch ratio, e.g. 1.8:1. Because of the relatively high line speed in heated tube 64, required generally to match the speed of once-drawn gel fibers 35 coming off of rolls 61 and 62, heated tube 64 in the third embodiment of FIG. 3 will, in general, be longer than heated tube 63 in either the second embodiment of FIG. 2 or the first embodiment of FIG. 1. While first solvent may exude from the fiber during stretching in heated tubes 57 and 64 (and be collected at the exit of each tube), the first solvent is sufficiently non-volatile so as not to evaporate to an appreciable extent in either of these heated tubes.

The twice-stretched first gel fiber 36 is then conducted through solvent extraction device 37, where the second, volatile solvent extracts the first solvent out of the fibers. The fibrous structures 43, containing substantially only second solvent, are then dried in drying device 45, and the twice-stretched fibers 70 are then taken up on spool 72.

It will be appreciated that, by comparing the third embodiment of FIG. 3 to the first two embodiments of FIGS. 1 and 2, the stretching step (F) is performed in the third embodiment in two stages, both subsequent to cooling step C and prior to solvent extracting step D.

The process of the invention will be further illustrated by the examples below.

EXAMPLES

The poly(vinyl alcohol) (PV-OH) used in the following examples was prepared by the method of T. C. Wu and J. West described in more detail in U.S. Pat. No. 4,463,138. The general procedures were as follows:

Poly(vinyl alcohol) A

The polymerization reactor consisted of a Pyrex® cylindrical tube having a diameter of 50 mm and a height of 230 mm. The reactor had a tubular neck of 15 mm diameter topped with a vacuum valve. The reactor was placed in a vacuum jacketed Dewar flask filled with methanol as a coolant which was cooled by a CryoCool cc-100 immersion cooler (Neslab Instruments, Inc.). A medium pressure ultraviolet lamp was placed outside the Dewar flask about 75 mm from the reactor.

Commercial high purity vinyl acetate was refractionated in a 200-plate spinning band column. The middle fraction having a boiling point of about 72.2° C. was collected and used as the monomer for preparing poly(vinyl acetate). The monomer was purified further by five cycles of a freeze-thaw degassing process in a high vacuum. About three hundred grams of the purified and degassed vinyl acetate was transferred into the reactor which contained 14 mg of recrystallized azobisisobutyronitrile. The initiator concentration was about $2.8\times10^{-4}$M.

The reactor was immersed in a methanol bath having a controlled temperature of −40° C. and irradiated with ultraviolet light over a period of 96 hours. The reaction mixture became a very viscous material. The unreacted monomer was distilled from the mixture under vacuum, leaving 87 grams of residue. The latter was dissolved in acetone and then precipitated into hexane. The polymer formed was dried in a vacuum oven at 50° C., yielding 54.3 grams (16% conversion) of poly(vinyl acetate). The intrinsic viscosity was determined to be 6.22 dL/g which corresponds to a viscosity average molecular weight of $2.7\times10^{6}$. The intrinsic viscosity measurement was conducted in tetrahydrofuran at 25° C.

Alcoholysis of the poly(vinyl acetate) was accomplished by initially dissolving and stirring the poly(vinyl acetate) in about one liter of methanol. To this mixture was added 2.5 g of potassium hydroxide dissolved in 50 mL of methanol. The mixture was stirred vigorously at room temperature. After about 30 minutes, the mixture became a gel-like mass. The latter was chopped into small pieces and extracted three times with methanol for removal of residual potassium salts. The polymer was dried in a vacuum oven at 50° C., yielding 24.5 grams of poly(vinyl alcohol).

Reacetylation was accomplished by heating a 0.3 gram sample of the poly(vinyl alcohol) in a solution containing 15 mL of acetic anhydride, 5 mL of glacial acetic acid, and 1 mL of pyridine in a 125° C. bath under nitrogen for 4 hours. The solution formed was precipitated into water, washed three times in water, redissolved in acetone, reprecipitated into hexane, and dried. The intrinsic viscosity of the reacetylated poly(vinyl acetate) was 6.52 dL/g.

Poly(vinyl alcohol) B and C

The reactor employed in this Example was a quartz tube having a 1.5 liter capacity and 76 mm diameter. The ultraviolet apparatus was a Special Preparative Photochemical Reactor, RPR-208 (The Southern New England Ultraviolet Company, Hamden, Conn.). The reactor was immersed in a cooling bath surrounded by eight U-shaped UV lamps.

A dry, nitrogen filled quartz reactor of the above-described type was charged with 508 g of purified vinyl acetate and 6.5 mg of azobisisobutyronitrile. The intiator concentration was about $8\times10^{-5}$ molar. After four cycles of freeze-thaw operations the reactor was immersed in a methanol bath at −40° C. and irradiated with ultraviolet light for about 80 hours. After the unreacted monomer had been recovered via standard distillation procedures, the residue was dissolved in acetone forming 1.5 liters of solution. One half of the acetone solution was precipitated into hexane as described in A, above, while the other half was precipitated into water. These two batches of poly(vinyl acetate) (B and C, respectively) had intrinsic viscosities of 6.33 and 6.67 dL/g, respectively, which corresponds to viscosity average molecular weights of about $2.7\times10^6$ and about $2.9\times10^6$. The total conversion of monomer was 12%.

Both were then hydrolyzed to poly(vinyl alcohol) as described in A.

Poly(vinyl alcohol) D

The polymerization was performed according to the procedure described for B and C except that the irradiation time (length of polymerization) was 96 hours. The conversion of monomeric vinyl acetate was 13.8% and the intrinsic viscosity was 7.26 dL/g, which corresponds to a viscosity average molecular weight of about $3.3\times10^6$. The weight average molecular weight of this polymer measured by a light scattering technique was found to be $3.6\times10^6$.

Poly(vinyl alcohol) E

A mixture containing 4.6 mg of azobisisobutyronitrile and 762 grams of pure vinyl acetate was placed in a Pyrex® glass reactor tube of 85 mm diameter and 430 mm length (capacity 2 liters). After four freeze-thaw cycles of degassing, the mixture was immersed in a methanol bath at −30° C. and irradiated with ultraviolet light for 66 hours. After the unreacted monomer had been removed, the residue was dissolved in acetone and the solution obtained was added to hexane with stirring whereby the poly(vinyl acetate) was precipitated. There was obtained 76.2 grams (10% conversion) of polymer with an intrinsic viscosity of 6.62 dL/g which corresponds to a viscosity average molecuar weight of about $2.9\times10^6$.

The poly(vinyl acetate) was hydrolyzed in methanol as described for A. A sample of the poly(vinyl alcohol) formed was reacetylated as described for A. The intrinsic viscosity of the reacetylated polymer was found to be 6.52 dL/g which is corresponding to a molecular weight of about $2.9\times10^6$. Thus, reacetylation demonstrated that the poly(vinyl acetate) originally formed was essentially linear. The batches of PV-OH prepared by these procedures are used in the following examples, with the identification, approximate molecular weight (weight average) and aspects of preparation differing from the above tabulation and in Table I:

TABLE I

| PV—OH | Mol Wt* | Spinning Scale | Process Features |
|---|---|---|---|
| A | $2.7\times10^6$ | 5 g/run | |
| B | $2.7\times10^6$ | 5 g/run | precipitated with water |
| C | $2.9\times10^6$ | 5 g/run | precipitated with hexane |
| D | $3.3\times10^6$ | | precipitated with hexane |
| E | $2.9\times10^6$ | | |

*The indicated molecular weights are for polyvinyl acetate. The PV—OH molecular weights would be one-half these values.

EXAMPLE 1

An oil-jacketed double helical (HELICONE®) mixer constructed by Atlantic Research Corporation was charged with a 6.0 weight percent solution of the PV-OH labeled "A" in Table I having a molecular weight of approximately 1.3 million and 94 weight percent glycerin. The charge was heated with agitation at 75 rev/min to 190° C. under nitrogen pressure over a period of two hours. After reaching 190° C., agitation was maintained for an additional two hours.

In Examples 1–5 the solution was discharged into a syringe-type ram extruder at the mixing temperature (190° C. in this Example 1) and expelled through a 0.8 mm diameter aperture at a reasonably constant rate of 0.7 $cm^3$/min.

The extruded uniform solution filament was quenched to a gel state by passage through a paraffin oil bath located at a distance of 5 cm below the spinning die. The gel filament was wound up continuously on a 2.5 cm (one inch) diameter bobbin at the rate of 2.5 m/min (8 feet/min). The fibers were drawn at feed rate of 260 cm/min and a 2.04:1 ratio at room temperature.

The bobbin of gel fiber was then immersed in methanol to exchange this second solvent for glycerin (and paraffin oil from the quench bath). The methanol bath was changed three times over 48 hours. The fibrous product containing methanol was unwound from the bobbin and the methanol solvent evaporated at 25° C. for 5 minutes.

The dried (xerogel) fiber was 188 denier. Part of this fiber was fed at 50 cm/min into a hot tube (180 cm) (six feet) long blanketed with nitrogen and maintained at 230° C. The fiber was stretched continuously 4.9/1 within the hot tube. The once-stretched fiber was then stretched in the same tube 1.54/1 at a tube temperature of 252° C. The properties of the twice-stretched fiber were:

denier—25,
tenacity—17.4 g/denier,
modulus—446 g/denier,
elongation—3.3%.

EXAMPLE 2

A second part of the dried gel fiber of Example 1 was stretched in the 180 cm tube at 231° C. at a feed rate of 50 cm/min and a draw ratio of 5.33:1. The properties of this once-stretched fiber were:

denier—31,
tenacity—14.5 g/denier,
modulus—426 g/denier,
elongation—3.5%.

EXAMPLE 3

The procedures of Example 1 were repeated using the polymer labeled "A" in Table 1, but using ethylene glycol as solvent in place of glycerol, and with the mixing and extrusion conducted at 170° C. instead of 190° C. The room temperature draw of the gel fibers was at a 2:1 draw ratio and the methanol extraction was conducted over 40 hours with the methanol replaced twice. A portion of the dried gel fiber was stretched in the 180 cm tube at 250° C. at a feed speed of 60 cm/min and a draw ratio of 5.9:1. The properties of the once-stretched fibers were:

denier—22,
tenacity—10.6 g/denier,
modulus—341 g/denier,
elongation—3.5%.

EXAMPLE 4

A second portion of the dried gel fiber of Example 3 was stretched twice in the 180 cm tube: first at 217° C. with a feed speed of 60 cm/min and a draw ratio of 4.83:1, second at 240° C. with a feed speed of 60 cm/min and a draw ratio of 1.98:1. The properties of this twice-stretched fiber were:

denier—18,
tenacity—13 g/denier,
modulus—385 g/denier,
elongation—4.0%.

EXAMPLE 5

Example 1 was repeated using the polymer labeled "B" in Table 1 as a 6% solution in glycerol at 210° C. mixed over 5¼ hours. The spin rate was 0.4 $cm^3$/min rather than the 0.7 $cm^3$/min used in Examples 1 and 3. The room temperature draw was at a feed rate of 310 cm/min and a 1.98:1 ratio and the extraction was conducted over 64 hours, with the methanol changed twice. The dried fibers were stretched once in the 180 cm tube at 254° C. with a 39 cm/min feed rate and a 4.6:1 draw ratio. The properties of the once-stretched fibers were:

denier—23,
tenacity—19.2 g/denier,
modulus—546 g/denier,
elongation—4.5%.

The results of Examples 1–5 are summarized in Table 2.

TABLE 2

| EXAMPLE | 1 | 2 | 3 | 4 | 5 |
|---|---|---|---|---|---|
| Polymer | A | A | A | A | B |
| Solvent | G | G | EG | EG | G |
| Spin Temp (°C.) | 190 | 190 | 170 | 170 | 210 |
| Spin Rate ($cm^3$/min) | 0.7 | 0.7 | 0.7 | 0.7 | 0.4 |
| R.T. Draw Ratio | 2.04 | 2.04 | 2.00 | 2.00 | 1.98 |
| 1st Stage Draw Temp | 230 | 231 | 250 | 217 | 254 |
| 1st Stage Draw Ratio | 4.90 | 5.33 | 5.90 | 4.83 | 4.60 |
| 2nd Stage Draw Temp | 252 | — | — | 240 | — |
| 2nd Stage Draw Ratio | 1.54 | — | — | 1.98 | — |
| Fiber Denier | 25 | 31 | 22 | 18 | 23 |
| Tenacity | 17.4 | 14.5 | 10.6 | 13.0 | 19.2 |
| Modulus | 446 | 426 | 341 | 385 | 546 |
| Elongation | 3.3 | 3.5 | 3.5 | 4.0 | 4.5 |

G = glycerol
EG = ethylene glycol
A, B refer to the polymers of Table 1

EXAMPLE 6

Example 1 was repeated using a melt pump and one-aperture die in place of the syringe-type ram extruder. A 5.5% solution of polymer D in glycerin was used. Thus, the bottom discharge opening of the Helicone™ mixer was fitted with a metering pump and a single hole capillary spinning die of 0.8 mm diameter and 20 mm length. The temperature of the spinning die was maintained at 190° C. as the solution was extruded by the metering pump through the die at a rate of 1.70 $cm^3$/min, with a 9 m/min take up speed. There was no room temperature draw. The first stage draw was in a six feet (180 cm) long tube purged with nitrogen with the first half at 75° C., the second half at 220° C. The feed speed was 99.4 cm/min, and the draw ratio was 2.6:1. The second stage draw was conducted with the first half of the same tube at 205° C., the second half at 261° C., the feed speed at 121.1 cm/min and the draw ratio of 1.34:1. The properties of the product fiber were 24 denier, 19 g/denier tenacity, 628 g/denier modulus and 3.9% elongation to break. With appropriate modification of stretching equipment it is expected that higher draw ratios and, therefore, better properties will be achieved.

We claim:

1. Polyvinyl alcohol fiber having a tenacity of at least 10 g/denier and a modulus of at least about 200 g/denier prepared by a process comprising the steps:

(a) forming a solution of a linear polyvinyl alcohol having a weight average molecular weight at least 500,000 in a first solvent at a first concentration between about 2 and about 15 weight percent polyvinyl alcohol, (b) extruding said solution through an aperture, said solution being at a temperature no less than a first temperature upstream of the aperture and being substantially at the first concentration both upstream and downstream of said aperture, (c) cooling the solution adjacent to and downstream of the aperture to a second temperature below the temperature at which a rubbery gel is formed, forming a gel fiber containing first solvent of substantially indefinite length, (d) extracting the gel fiber containing first solvent with a second, volatile solvent for a sufficient contact time to form a fibrous fiber structure containing second solvent, which gel is substantially free of first solvent and is of substantially free of first solvent and is of substantially indefinite length;

(e) drying the fibrous structure containing second solvent to form a xerogel fiber of substantially indefinite length free of first and second solvent; and (f) stretching at least one of:

(i) the gel fiber containing the first solvent, (ii) the fibrous fiber structure containing the second solvent and, (iii) the xerogel, fiber, at a total stretch ratio sufficient to achieve a tenacity of at least about 10 g/denier and a modulus of at least about 200 g/denier.

2. The fiber of claim 1 wherein said aperture has an essentially circular cross-section.

3. The fiber of claim 1 wherein said first temperature is between about 130° C. and about 250° C.; said second temperature is between about 0° C. and about 50° C.; the cooling rate between said first temperature and said second temperature is at least about 50° C./min; and said first solvent is an alcohol.

4. The fiber of claim 3 wherein said first solvent has a vapor pressure less than 80 kPa at said first temperature and said second solvent has an atmospheric boiling point less than 80° C.

5. The fiber of claim 1 wherein said first solvent has a vapor pressure less than 80 kPa at said first temperature and said second solvent has an atmospheric boiling point less than about 80° C.

6. The fiber of claim 1 wherein said first solvent is a hydrocarbon polyol or alkylene ether polyol having a boiling point (as 101 kPa) between about 150° C. and about 300° C.

7. The fiber of claim 6 wherein said first solvent is glycerol.

8. The fiber of claim 1 wherein said total stretch ratio is between about 3/1 and about 70/1.

9. The fiber of claim 2 wherein said total stretch ratio is between about 3/1 and about 70/1.

10. The fiber of claim 1 wherein said stretching step (f) is conducted in at least two stages.

11. The fiber of claim 10 wherein first stretching stage is of gel fiber containing the first solvent.

12. The fiber of claim 11 wherein a second stretching stage is of the gel fiber containing the first solvent.

13. The fiber of claim 11 wherein a second stretching stage is of the xerogel fiber.

14. The fiber of claim 10 wherein at least two stretching stages are performed on the xerogel fiber.

15. The fiber of claim 1 wherein the stretching is primarily performed on the xerogel fiber.

16. The fiber of claim 1 wherein at least a portion of stretching is performed at a temperature between about 120° C. and about 275° C.

17. The fiber of claim 16 wherein the stretching is performed in at least two stages with the latest stage performed at a temperature of between about 150° C. and about 250° C.

18. The fiber of claim 17 wherein said latest stage is performed on the xerogel fiber.

19. The fiber of claim 1 wherein said linear polyvinyl alcohol has a weight average molecular weight of between about 1,000,000 and about 4,000,000.

20. The fiber of claim 19 wherein said linear polyvinyl alcohol has a weight average molecular weight of between about 1,500,000 and about 2,500,000.

21. A fiber of claim 1 wherein said polyvinyl alcohol has weight average molecular weight at least about 500,000 and a tenacity of at least about 10 g/denier, a tensile modulus of at least about 200 g/denier and a melting temperature of at least about 238° C.

22. The fiber of claim 21 wherein said polyvinyl alcohol has a melting temperature of at least about 245° C.

23. The fiber of claim 21 wherein said polyvinyl alcohol has u weight average molecular weight of at least about 750,000.

24. The fiber of claim 21 having a tenacity of at least about 14 g/denier and a tensile modulus of at least about 300 g/denier.

25. A fiber of claim 22 wherein said polyvinyl alcohol has an average molecular weight of at least about 750,000 and having a tenacity of at least about 14 g/denier and a tensile modulus at least about 300 g/denier.

26. The fiber of claim 25 wherein said polyvinyl alcohol has a tenacity of at least about 17 g/denier and a tensile modulus of at least about 400 g/denier.

27. The fiber of claim 26 wherein said polyvinyl alcohol has a tensile modulus of at least about 550 g/denier.

28. The fiber according to claim 21 wherein the polyvinyl alcohol has a weight average molecular weight of between about 1,000,000 and 4,000,000.

29. The fiber according to claim 28 wherein the polyvinyl alcohol has a weight average molecular weight of between about 1,500,000 and 2,500,000.

* * * * *